United States Patent [19]

Spears

[11] Patent Number: 4,749,185

[45] Date of Patent: Jun. 7, 1988

[54] AMUSEMENT DEVICES

[76] Inventor: James A. Spears, 5108 Sandy La., Fairfield, Ohio 45014

[21] Appl. No.: 928,877

[22] Filed: Nov. 10, 1986

[51] Int. Cl.[4] ..... A63B 43/02

[52] U.S. Cl. ..... 272/77; 272/78

[58] Field of Search ..... 272/76, 77, 78, 93

[56] References Cited

U.S. PATENT DOCUMENTS

| | | | |
|---|---|---|---|
| 299,091 | 5/1884 | Rumsy | 272/77 |
| 341,231 | 5/1886 | Goodman | 272/78 |
| 426,944 | 8/1890 | Lovatt | 272/78 |
| 474,760 | 5/1892 | Peterson | 272/78 |
| 663,690 | 12/1900 | Whitely et al. | 272/77 |
| 708,573 | 9/1902 | Miles | 272/76 |
| 770,869 | 9/1904 | Roe | 272/78 |
| 2,045,972 | 6/1936 | Tompkins | 272/77 |
| 4,345,755 | 8/1982 | Eidson | 272/78 |

FOREIGN PATENT DOCUMENTS

| | | | |
|---|---|---|---|
| 2113601 | 9/1972 | Fed. Rep. of Germany | 272/78 |

*Primary Examiner*—David A. Scherbel
*Assistant Examiner*—Richard E. Chilcot, Jr.
*Attorney, Agent, or Firm*—Kinney & Schenk

[57] ABSTRACT

An amusement device is shown which comprises a lightweight bag tethered at its opposite ends to upper and lower, pivotal swivels. The bag is suspended by the upper cord and the lower cord has a length substantially greater than the normal distance of the bag from the lower swivel. The bag is readily deformable and resilient so that it cannot cause injury. The cords are elastic and resilient so that when it is struck by a players hand, or fist, it gyrates and travels in an unpredictable fashion presenting a challenge to its being repetitively hit, as is the object of its competitive use where players attempt to cause the bag to strike an opponent. The device is uniquely adapted for use by persons confined in wheel chairs.

2 Claims, 1 Drawing Sheet

AMUSEMENT DEVICES

The present invention relates to improvements in amusement devices and more particularly devices which involve physical exertion.

There is a demonstrated need for amusement devices which involve physical activity, or exertion, and thus stimulate the cardio-vascular system and yet are more enjoyable than jogging and other more structured activities in which so many have participated for the past several years.

One type of device which generally serves such purpose is a tethered ball, connected by a string or cord to a fixed pivot point, as shown in U.S. Pat. No. 2,496,795. The usual practice is for two or more persons to strike the ball with their fists attempting to do so in such a manner that the other person will not be able to hit it, as it comes towards him.

This type of device has the added advantage of stimulating eye-hand coordination. Further the challenge of competition makes enjoyable the time spent in enhancing a person's physical condition, improving muscle tone and other well know benefits. Another form of such device, which is self contained, and capable of use both indoors and out, is found in U.S. Pat. No. 3,262,703. The object of play for this device is to strike the tethered ball with a paddle.

While prior devices of this type do not have any major structural drawbacks, the path of travel of the ball is reasonably predictable, thus limiting the challenge of striking it.

Further, the type of tethered balls heretofore used tends to limit the exertion level reached in playing games with theses devices.

Accordingly a primary object of the present invention is to provide an amusement device which promotes physical exercise through a greater challenge in striking a tethered object.

Further, it is an object of the invention to provide an amusement device which stimulates competition and enhances physical exertion, all without danger of injury.

Another object of the invention is to attain the foregoing objects with a device which may be removed when not in use and thus can be set up in many different locations.

The foregoing ends are attained through a device which comprises a lightweight bag tethered at opposite ends by cords connected, respectively to upper and lower swivels. The bag is further characterized by being soft and yet resilient so that a person will not be injured, even if struck in the face by the bag. The upper cord is, and the lower cord may be, both elastic and resilient.

In competitive use, players stand on opposite sides of the bag and hit it with their hands or fists, attempting to do so in such fashion that another player will not be able to prevent the bag from striking his body or head. The bag is primarily constrained in an arcuate or conical range of movement by the upper cord with the lower cord limiting this range of motion.

Striking the bag with a solid blow which will cause it to hit an opponent is a substantial challenge. This is due to the fact that the bag gyrates in an unpredictable fashion due to the elastic/resilient characteristics of the upper cord, as well as the effect of the lower cord in limiting arcuate travel of the bag.

The above and other related objects and features of the invention will be apparent from the reading of the following description of a preferred embodiment, with reference to the accompanying drawing and the novelty thereof pointed out in the appended claims.

IN THE DRAWING

Figure 1:
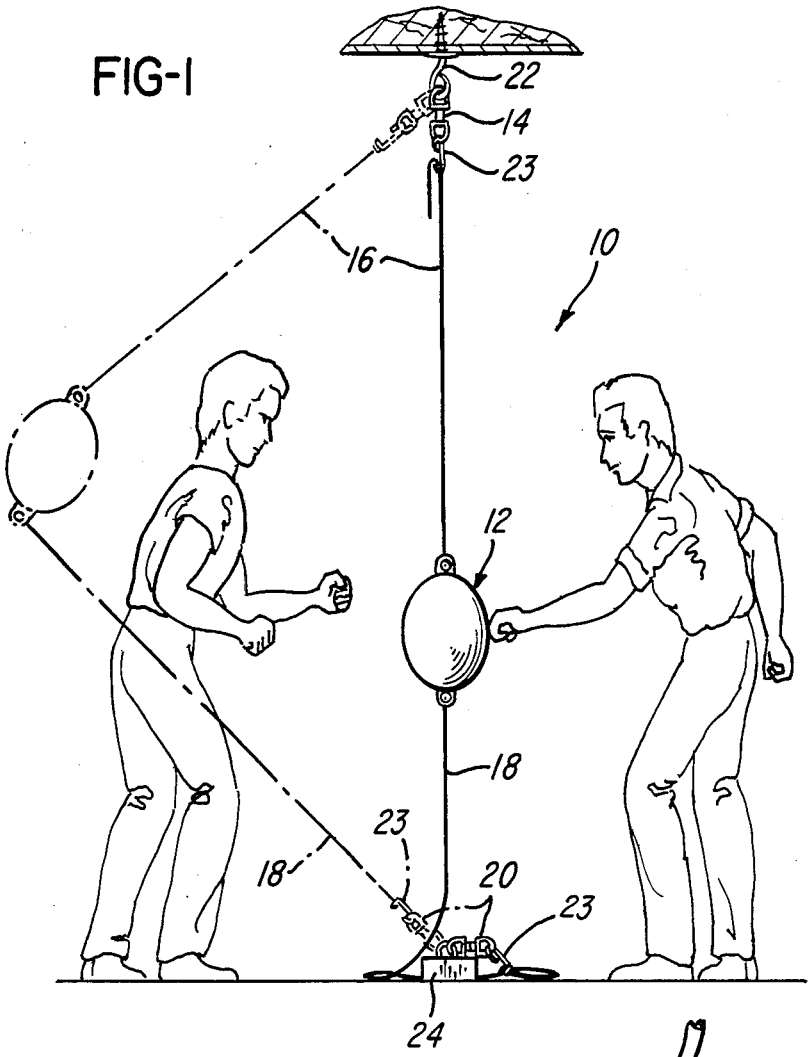
FIG. 1 is an elevation illustrating an amusement device embodying the present invention.

The present invention is quite simple, as will be seen from FIG. 1. The device, indicated generally by reference character 10, comprises a bag 12 which is tethered at its upper end to a fixed swivel 14, by an elastic cord 16. The lower end of the bag is then tethered by a second elastic cord 18, to a fixed swivel 20, preferably disposed in vertical alignment to the upper swivel 14.

The upper swivel 14 requires some means of suspension. As illustrated in the drawing this requirement may be met by attaching it to a closed hook, or eye, 22 screwed into an overhead ceiling member. Alternatively, separate means, independent of any building structure, could be employed.

The lower swivel 20 is connected to a weight 24, which holds it a fixed position on the floor, beneath the ceiling eye 22. In a permanent installation, the lower swivel 20 could be secured directly to the floor. Alternatively it could be secured to an independent structure which also carries the upper eye 22.

Figure 3:
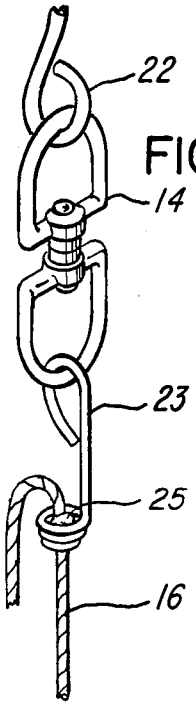
FIG. 3 is a perspective view, on an enlarged scale, of a swivel connection of the upper end of the cord to a fixed screw eye.

The cords 16 and 18 may be provided with hooks 23 to provide for their attachment to the swivels 14 & 20, as is indicated in FIG. 3, each cord being secured to the hook 23. Preferably, and as shown, the ends of the hooks 23 are bent to a closed position so that they will not disengage from the swivels to which they are attached.

The described use of the weight 24 as a means for positioning the lower swivel 20 and the ceiling eye 22 from which the upper pivot may be detached is preferred for purposes of ease of use. The device may be put in use simply by making attachment with the eye 22 and positioning the weight 24. When play with the device is finished and it is desired to use the area for other purposes, the eye 22 is bent to an open position to permit removal of the swivel 14, and the device 10, weight and all may be readily stored with only minimum space requirements. Atlernatively, the hook 23 may be bent to an open position to permit its detachment from the swivel 14.

Figure 2:
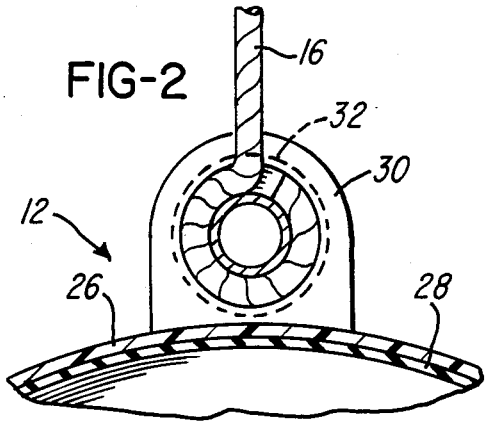
FIG. 2 is an enlarged view, partially in section of a portion of a bag employed herein, showing its connection to a cord.

For purposes which later appear, the bag 12 is preferably formed by a skin 26 (FIG. 2) of leather, or plastic sheet having characteristics similar to leather. An elastic bladder 28 is provided within the bag and inflated to provide the generally ovaloid shape preferred. The unique characteristics of the bag is that the bladder is inflated, or pressurized, to a relatively low pressure, essentially, only that required to obtain the ovaloid shape. The end result is that the ball is lightweight and quite soft, but yet resilient enough to maintain its ovaloid shape. Preferably the length of the bag is approximately 12 inches and its diameter an inch or so smaller.

Tabs 30 project from the upper end of the bag. The cord 16 is captured between these tabs and secured thereto by a grommet 32. The cord 18 is simularly connected to the lower end of the bag 12. The tabs 30 are soft and flexible so that they will not be a source of injury when a player strikes or is struck by the bag.

The cords 16 and 18 are both resilient and highly elastic, yet possess a good degree of strength so that they are not readily broken. Such characteristics are found in cords of approximately ¼ inch diameter, which are readily available from present commercial sources in a range of elasticity which provide the desired ends herein.

It will further be noted that the upper cord 16 positions the bag when it is at rest and provides the primary control for limiting movement of the bag as it is struck by players, as is next described. Preferably the length of the cord 16 is set to position the bag 12, when it is at rest, at approximately the waist level the lower portions of the chest of the players. Adjustment of the length of the cord 16 may be had by tying a knot in the cord. The knot is caught in a coiled opening 25 formed in the lower end of the hook 23. The lower cord 18, is of a length which limits the arcuate movement of the bag so that it will not travel a substantial distance behind the players and thus remain "in play", as illustrated in FIG. 1.

The present device is particularly well received as a means of competition between 2–8 individuals, acting individually or as teams. For simplicity, its use will be described with references to two persons. The players stand on opposite sides of the ball, spaced apart a distance at least sufficient that they cannot contact each other when their arms are outstretched. A circle of arbitrary diameter may be drawn on the floor to properly space the players from each other.

The bag 10 is set in motion and the players strike at it with their hands, preferably clinched as fists, their object being to cause the bag to strike their opponent. This is a challenge of great proportion in that bag swings freely from about the swivel 14 and a direct hit on its center is required to drive it in a desired direction. The elasticity and resiliency of the cord 16 uniquely adds to this challenge. Thus, the force of a blow stretches this cord and then it retracts, superposing further movement vectors on the arcuate constraint of the pivoting swivel 14. Striking a solid blow on the bag becomes a greatly enhanced challenge and provides improved amusement and exercise values.

The lower cord 18 limits arcuate movement of the bag 10 about the pivoting swivel 14. This serves two functions. First the bag remains "in play" and does not swing out of the playing zone so that it cannot be struck by the players with uninteresting "lost time". Secondly, when the bag reaches such limit of movement, the combined elastic/resilient characteristics of the two cords 16, 18 add further to the unpredictability of its path of travel, thus additionally increasing the challenge of striking the bag, let alone striking it with a solid blow.

While it is a challenge simply to strike the bag, further interest and competitiveness is added by scoring points for striking the bag to cause it to strike an opponents torso and added points where the opponents' face is struck.

The low pressure inflation and relatively light weight of the bag 10 prevent injury to a person struck by the bag, even when struck in the face. On the other hand, the ruggedness of the leather or leatherlike casing, and again the softness of the bag, enable the bag to be struck with all the force a person can muster, still without injury to an opponent. The level of exertion is enhanced by the preferred dimensions of the bag 12.

Thus the nature of the device is such that cardio-vascular stimulation is promoted by the challenge of striking the gyrating bag which leads to the desire to strike it with greater force, to the end that virtually all muscles are involved and muscle tone is promoted by the rapidity of movement.

Another not so obvious benefit is that aggressions and frustrations can be worked off by striking the bag with extreme force and transferred intent, without causing injury. Thus both physical and mental health can be improved by the present device.

Another unique use of the present device is by persons confined to wheel chains. The wheel chairs can be locked in appropriate positions on opposite sides of the bag. The knot in the cord 16 is relocated so that the bag is preferable adjusted to the chest level of the players in the wheel chairs. From a sitting position the bag can be struck with blows approaching the force employed by nonhandicapped persons. The device is thus especially beneficial in promoting exercise in this group of persons who are prone to suffer from physical inactivity.

It will, of course, be appreciated, that competition is not required to derive enjoyment from this device. The double tethers for the bag 10 facilitate its use by a single person to obtain exercise and hand to eye coordination of an entirely different, and more challenging nature than provided by other devices, such as tethered bags employed in the training of boxers.

The bag may also be struck by player's feet using foot kicks as are employed in karate.

As has been intimated in the proceding description and will be apparent to those skilled in the art, variations from the specific embodiment disclosed can also be employed within the spirit of the present invention and accordingly the scope thereof is to be derived from the following claims.

Having thus described the invention, what is claimed as novel and desired to be secured by Letters Patent of the United States is:

1. An amusement device for promoting exercise, said device comprising an upper pivotal swivel, a resilient, elastic cord conencted to and depending from said upper swivel, with its lower end in an elevated position, a lightweight, soft bag, characterized by easy and resilient deformability, said bag being connected to the lower end of said resilient cord and positioned thereby in an elevated position, for free movement universally relative to said upper pivot, when struck by one using the device, a lower pivotal swivel, and second cord connecting said lower swivel and the lower end of said bag, said second cord having a length substantially greater than the distance between the lower swivel and the lower end of the bag, when the bag is at rest, the length of said second cord being less than the farthest distance the bag may travel away from the lwoer swivel, when it is moved relative to the upper swivel, by being struck, whereby movement of the bag, upon being struck, is initially constrained by the resilient cord, relative to the upper swivel and then by the second cord when the the lower end of the bag is displaced from the lower swivel a distance equal to the length of second cord, thus producing random movement, universal movement of the bag.

2. An amusement device as in claim 6 wherein the second cord is also elastic and resilient.

* * * * *